United States Patent [19]

Andric

[11] Patent Number: 4,765,027

[45] Date of Patent: Aug. 23, 1988

[54] DOOR HINGE

[76] Inventor: Milos D. Andric, 1635 Central Ave., Wilmette, Ill. 60091

[21] Appl. No.: 879,921

[22] Filed: Jun. 30, 1986

[51] Int. Cl.[4] ..... E05D 7/00

[52] U.S. Cl. ..... 16/354; 16/371

[58] Field of Search ..... 16/354, 371; 49/246, 49/383; 52/238.1, 243.1, 32, 207

[56] References Cited

U.S. PATENT DOCUMENTS

| | | | |
|---|---|---|---|
| 283,416 | 8/1883 | Pattison . | |
| 414,461 | 11/1889 | Towson . | |
| 465,112 | 12/1891 | Kearsing | 16/354 |
| 509,702 | 11/1893 | Tangney . | |
| 993,227 | 5/1911 | DeRose . | |
| 1,220,084 | 3/1917 | Francksen . | |
| 2,067,042 | 1/1937 | Bloom . | |
| 2,072,028 | 2/1937 | Cooper | 16/354 |
| 2,206,739 | 7/1940 | Brogren et al. . | |
| 2,219,358 | 10/1940 | Economides . | |
| 2,516,935 | 8/1950 | Weaver | 16/354 |
| 3,016,261 | 1/1962 | Tatter . | |
| 3,092,870 | 6/1963 | Baer . | |
| 3,374,499 | 3/1968 | Horstman . | |
| 3,402,422 | 9/1968 | Baer | 16/354 |
| 3,973,289 | 8/1976 | Yulkowski . | |
| 4,056,985 | 11/1977 | Worrallo | 16/354 |

FOREIGN PATENT DOCUMENTS

| | | | |
|---|---|---|---|
| 0800101 | 9/1950 | Fed. Rep. of Germany | 16/354 |
| 2457413 | 6/1975 | Fed. Rep. of Germany | 16/354 |
| 1542245 | 3/1979 | United Kingdom | 16/354 |
| 1596274 | 8/1981 | United Kingdom | 16/354 |

*Primary Examiner*—Kurt Rowan

*Attorney, Agent, or Firm*—Richard G. Kinney

[57] ABSTRACT

A concealed swinging door hinge which allows a door to close with a better fit to the jam or adjacent door and yet allows the door to open a full one hundred and eighty degrees and provides good clearance when so open is disclosed in four embodiments. In each embodiment, the hinge employs a link member between the door and jam which defines two vertical hinges, one coupled to the jam and the other to the door. The hinge includes means for advancing the respective hinge axes out from the jam and door as the door swings open, and for retracting them as it swings closed, as well as means for coordinating such hinge advance and retreat so that each advances and retreats at least approximately the same distance as the door swings open or closed. In the first embodiment, the link member forms continuous hinges down the entire length of the door with two arm members, one coupled to the jam and one to the door. These arm members can each pivot at their respective points of attachment to the jam or door, and the advancement and retreat is achieved by two partial gears affixed at each continuous hinge, one of which meshes in a gear block affixed to the jam and the other in a gear block, affixed to the door. Coordination is achieved by a set of two partial gears and two full gears, all intermeshing with the two partial gears attached to the two arm members.

16 Claims, 16 Drawing Sheets

DOOR HINGE

FIELD OF THE INVENTION

The present invention is directed to a new and improved door hinge assembly and especially to a concealed door hinge.

BACKGROUND OF THE INVENTION

Doors and their suspension from jams predate written history. Despite humanity's long experience with doors, jams, and hinges, these common items have been the subject of much improvement and invention. Compound and "invisible" door hinges and continous-hinge arrangements have been suggested in U.S. Pat. Nos.: 283,416; 414,461; 509,702; 993,227; 1,220,084; 2,067,042; 2,206,739; 2,219,358; 3,016,261; 3,092,870; and 3,374,499.

The relatively recent U.S. Pat. No. 3,973,289 to Yulkowski discloses a commercially-employed hinge that is hidden and allows for swing of up to 180 degrees. This hinge, and others like it, however, suffer from the drawback that they require a large spacing or gap between the vertical side edge of the door and the jam. It also provides a double hinge arrangement, wherein the angles of pivot of the individual hinges are not coordinated with each other. That is, one can pivot a large angle while the other doesn't pivot at all.

Architects and others concerned with the appearance of doors and jams generally prefer that there exist little or no visible gap between the closed door and the jam and that the hinges be "invisible"; that is, hidden from sight when the door is closed. Further, it is, of course, desirable that the door hinge and jam perform their function of closing the opening with strength and operate smoothly and reliably and consistently in the same manner.

SUMMARY OF THE INVENTION

Toward achieving one or more of these ends, or to overcome some of the drawbacks of the prior art, a swinging door, hinge, and jam arrangement provided in accordance with the present invention encompasses a link member that with two arm members forms two spaced-apart hinges and coordinating means for tending to maintain the link member symmetrically related between the door and jam as it swings open and shut, and includes means for advancing the hinge axes out from the jam and out from the door as the door initially swings away from the jam, and for retracting them as it swings back into contact with the jam.

The moving hinge point arrangement allows the door edge to be closer to the jam when closed and to be hidden by being recessed within the edge of the door and jam to produce an invisible or hidden hinge.

The invention, together with the advantages thereof, may best be understood by reference to the following description taken in connection with the accompanying drawings, in the several figures of which, like reference numerals identify like elements.

Figure 13:
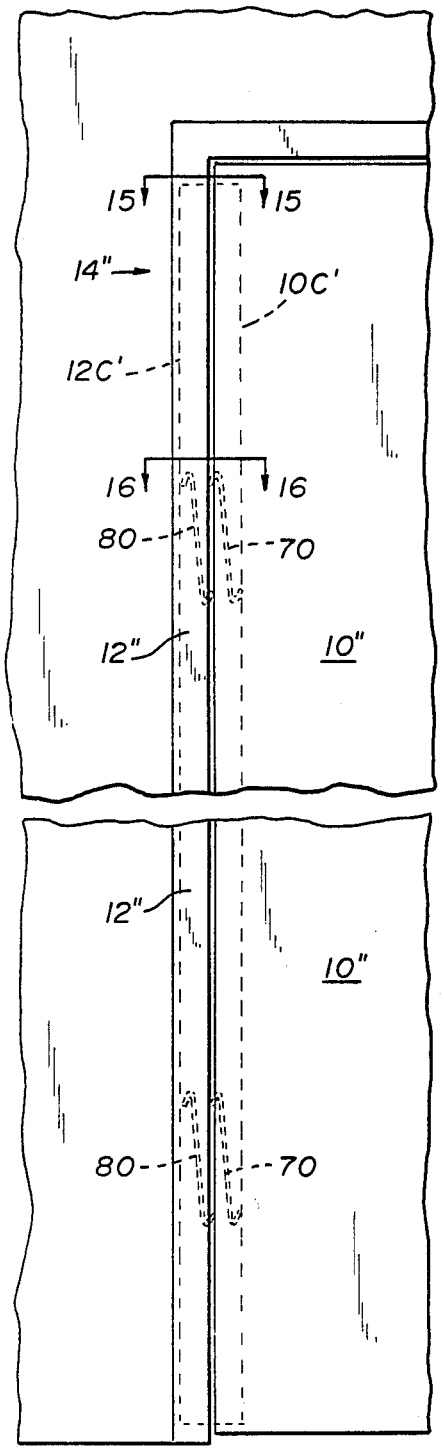
FIG. 13 is a broken elevational view of a third door, jam, and hinge assembly, constituting a third embodiment of the present invention, with internal parts shown in phantom outline.
Figure 14A:
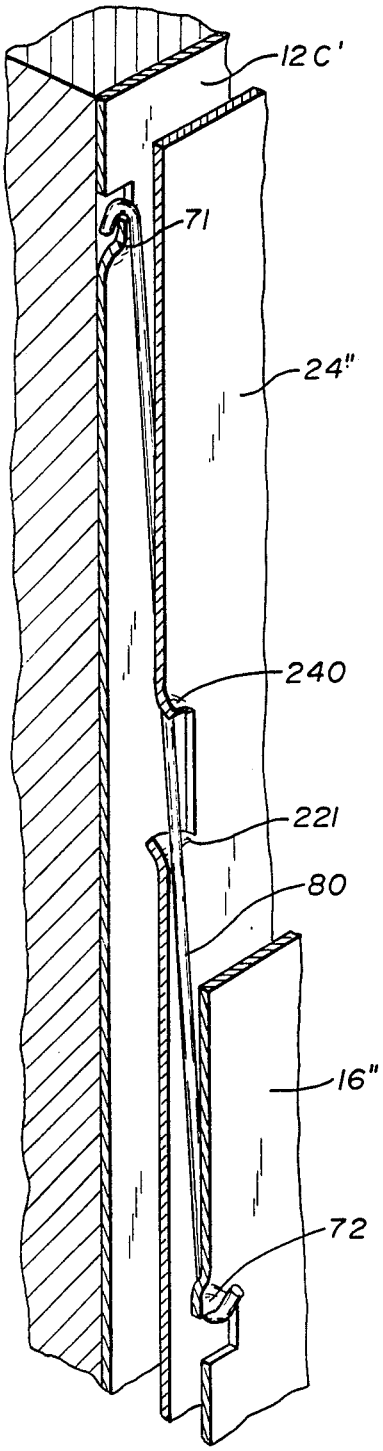
Figure 14B:
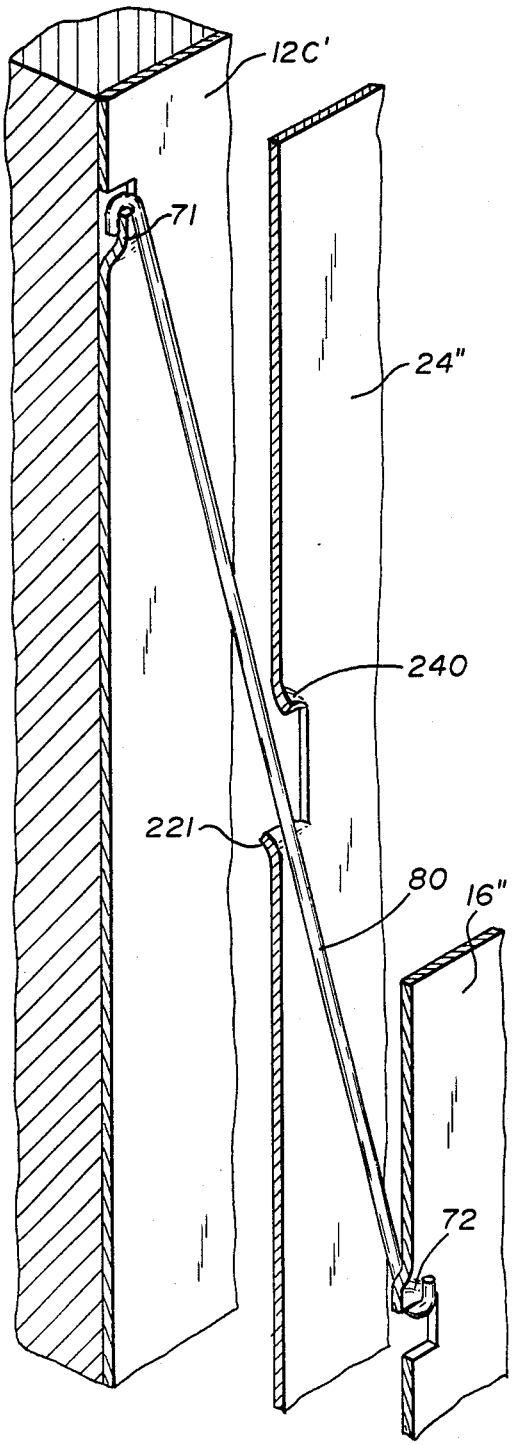

FIGS. **14*a* and 14*b* are each a sectional elevational detailed view of certain parts of the assembly of FIG. 13, with FIG. 14*b*** showing the parts in a moved position.

Figure 15:
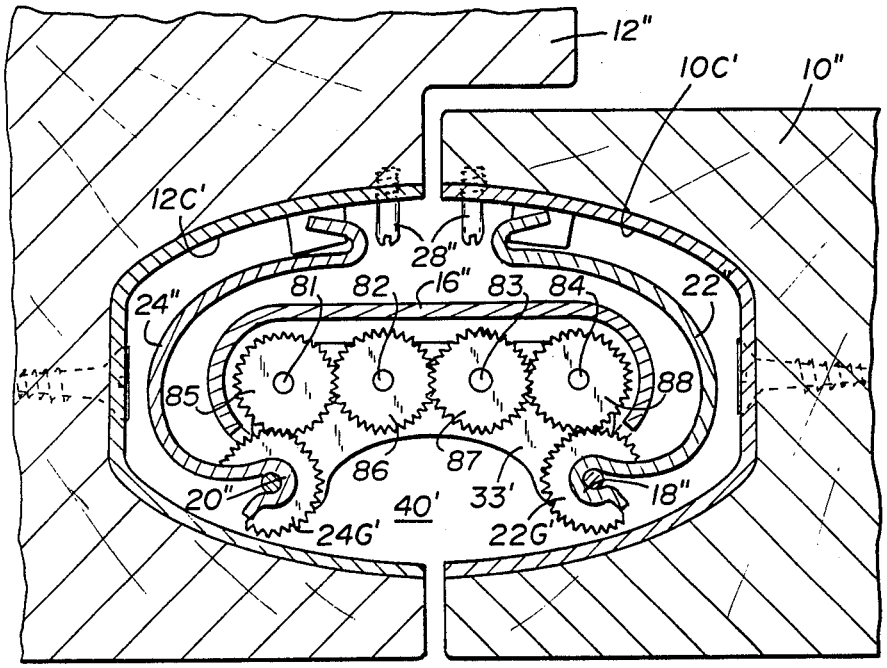

FIG. 15 is a sectional plan, view of the embodiment of FIGS. 13, **14*a* and 14*b*, as seen from the plane defined by the line 15—15 in FIG. 13** when looking in the direction of the arrows.

Figure 16:
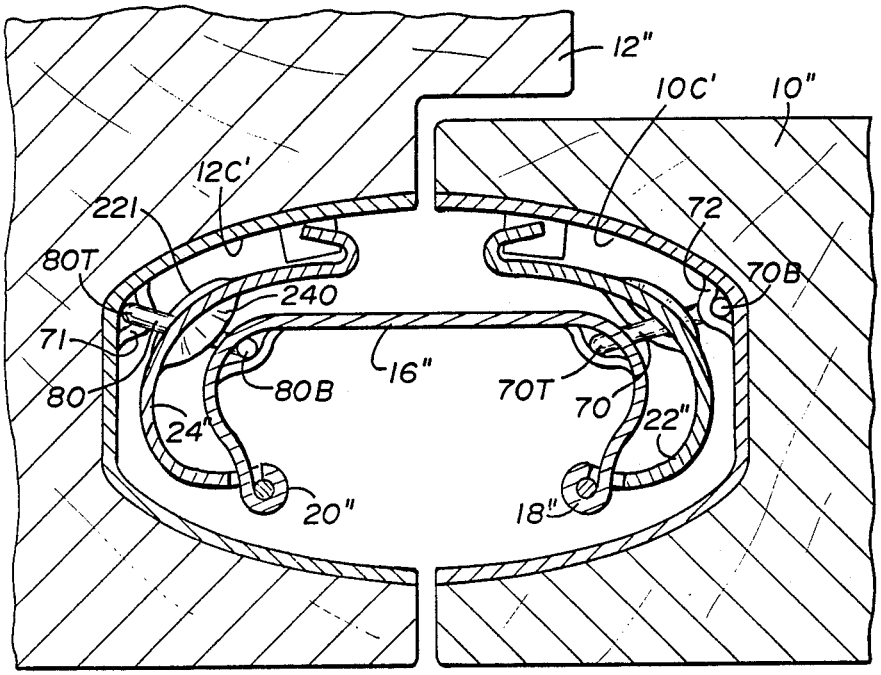

FIG. 16 is a sectional plan, view of the embodiment of FIGS. 13–15, as seen from the plane defined by the line 16—16 in FIG. 13 when looking in the direction of the arrows.

Figure 17:
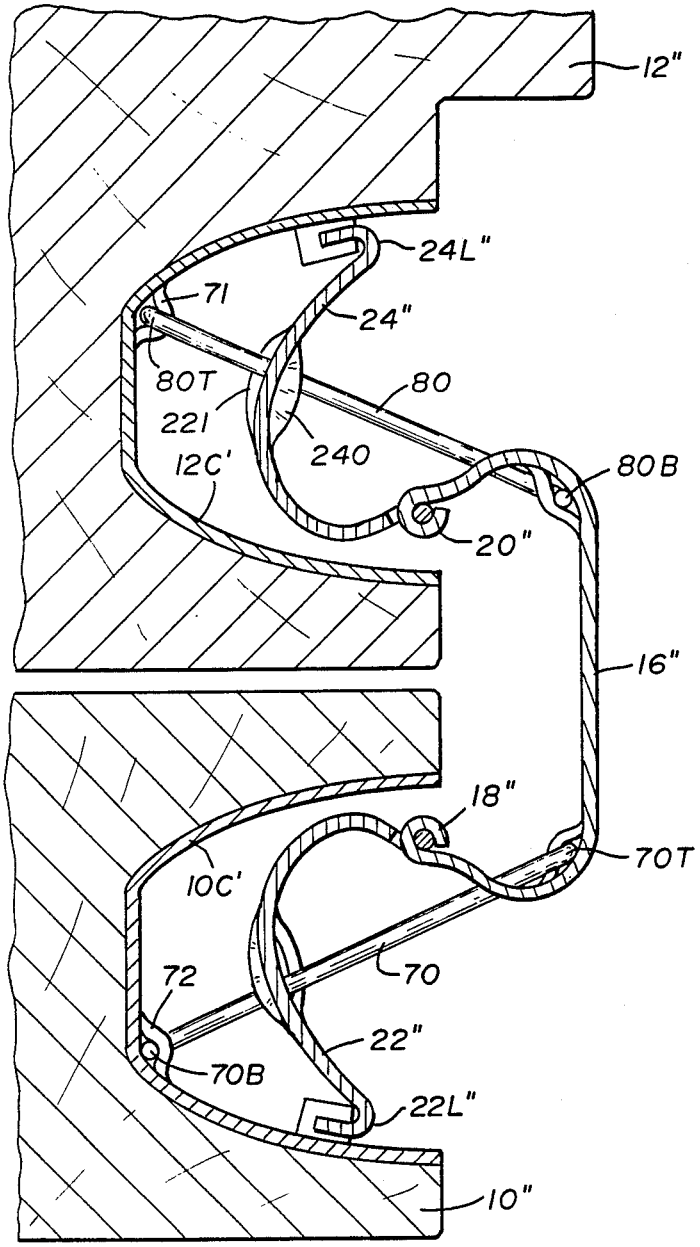

FIG. 17 is a view similar to that of FIG. 16 but with parts shown in a moved position.

Figure 18:
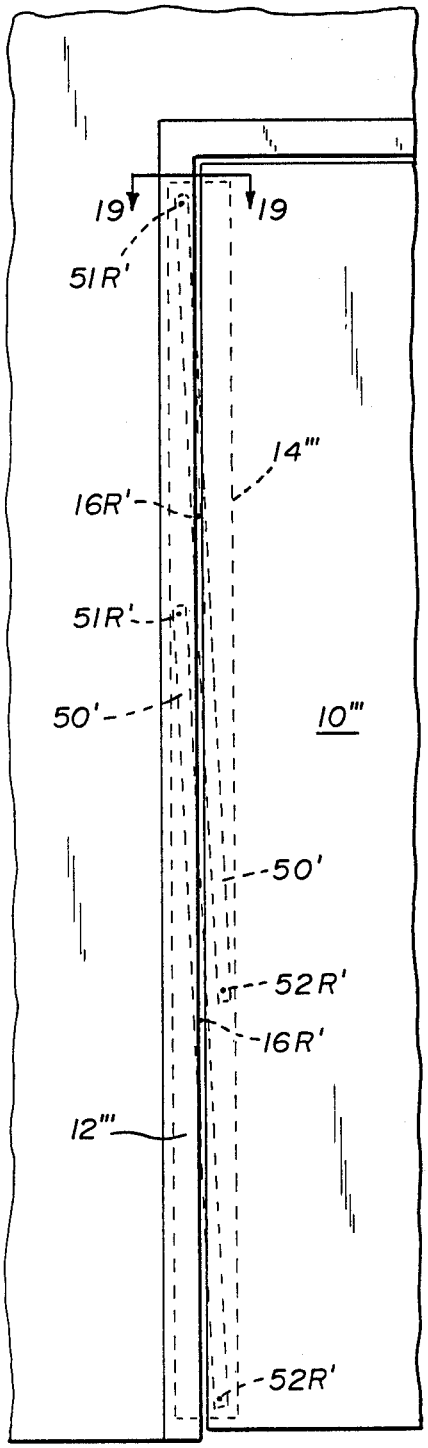

FIG. 18 is an elevational view of a fourth door, jam, and hinge assembly, being a fourth embodiment of the invention, with certain internal hinge parts shown in phantom outline.

Figure 19:
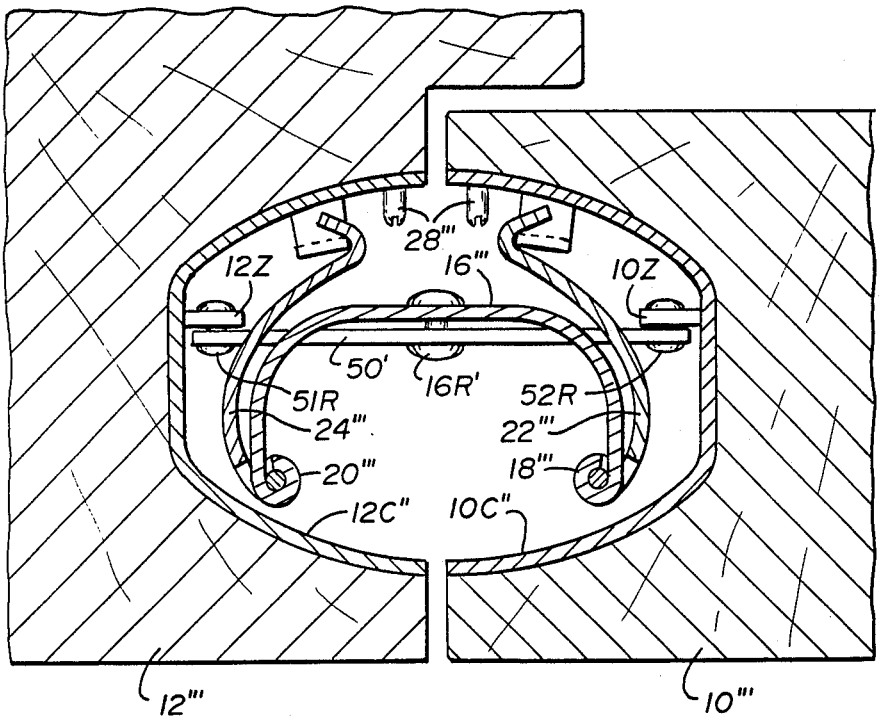

FIG. 19 is a partial sectional plan, view, as seen from the line 19—19 in FIG. 18.

Figure 20:
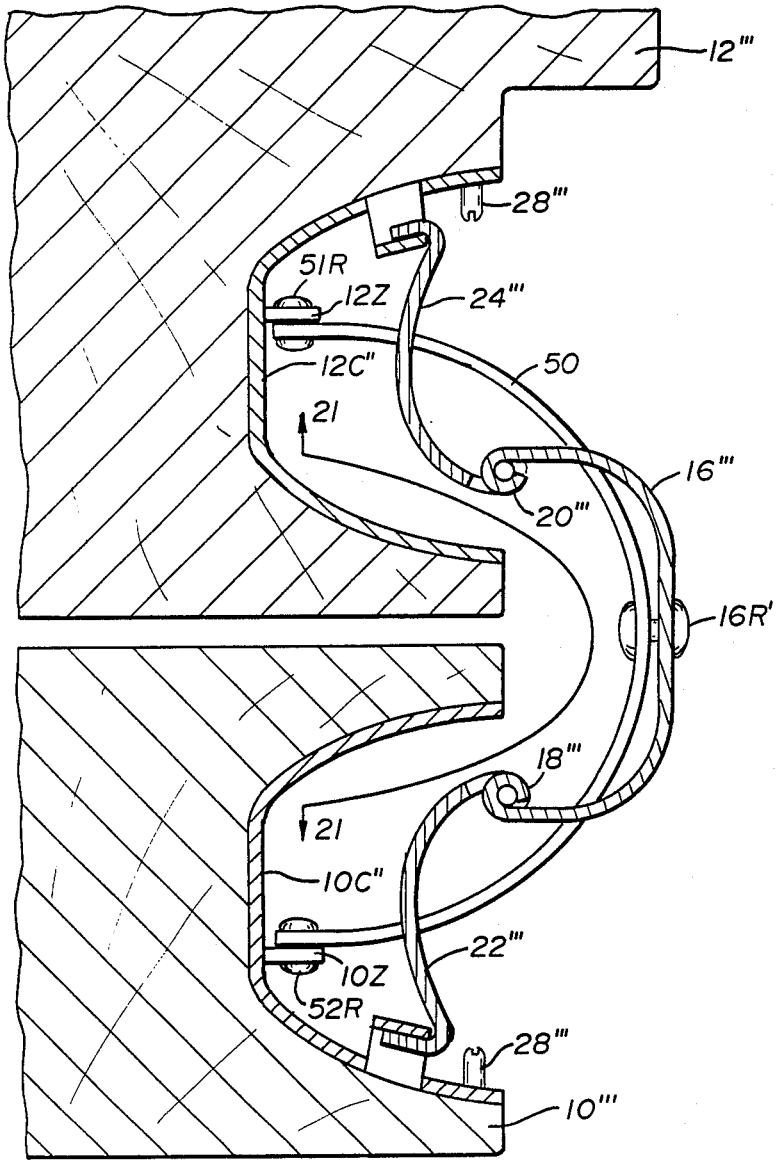

FIG. 20 is a view similar to that of FIG. 19 but with the door opened 180 degrees.

Figure 21:
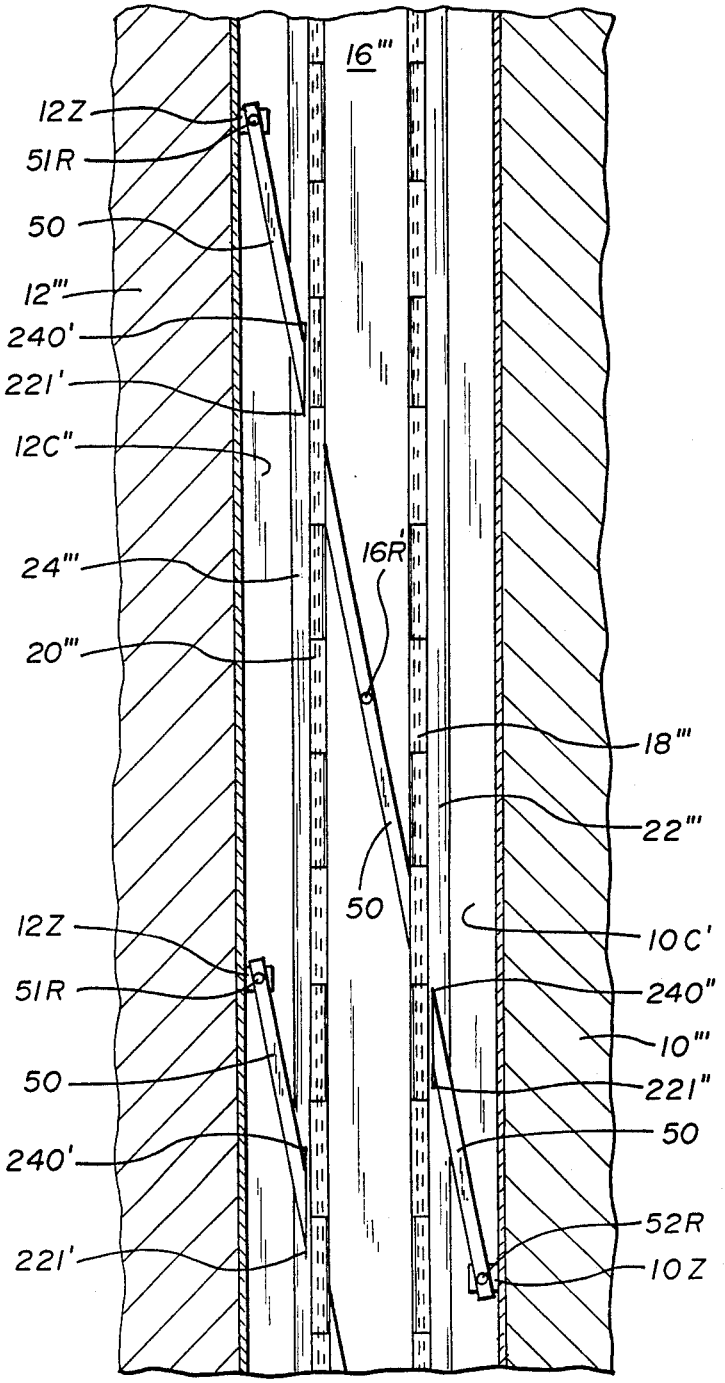

FIG. 21 is a projection partial view, partly in section, of the apparatus of FIGS. 18–20, as seen from the surface, defined by the curved line 21—21 in FIG. 20.

DETAILED DESCRIPTION OF PREFERRED EMBODIMENTS

Figure 1:
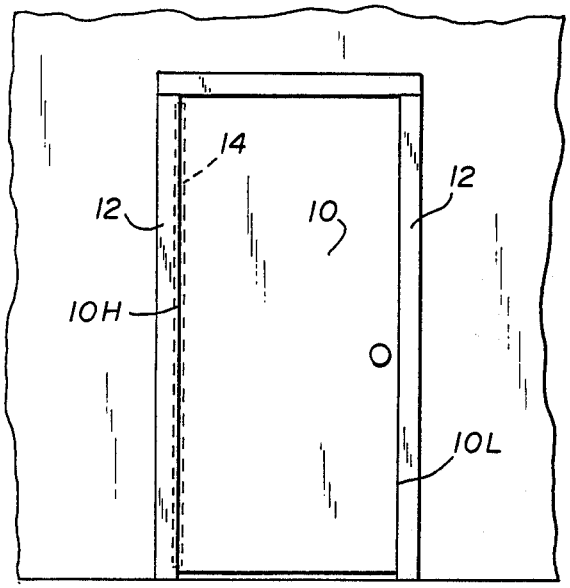
FIG. 1 is an elevational view of a door jam and hinge assembly constructed in accordance with the present invention.

Referring to FIGS. 1–8, and especially FIG. 1, there is depicted a door 10, a jam 12, and a hinge assembly generally designated 14, constructed in accordance with the principles of the present invention.

The door 10, which may swing inward or toward the viewer as depicted in FIG. 1, fits closely to the jam 12 at both its hinge edge 10H and its opposite or latch edge 10L. Note, also, that no hinge is exposed to view along the hinge side 10H when the door is closed.

Figure 2:
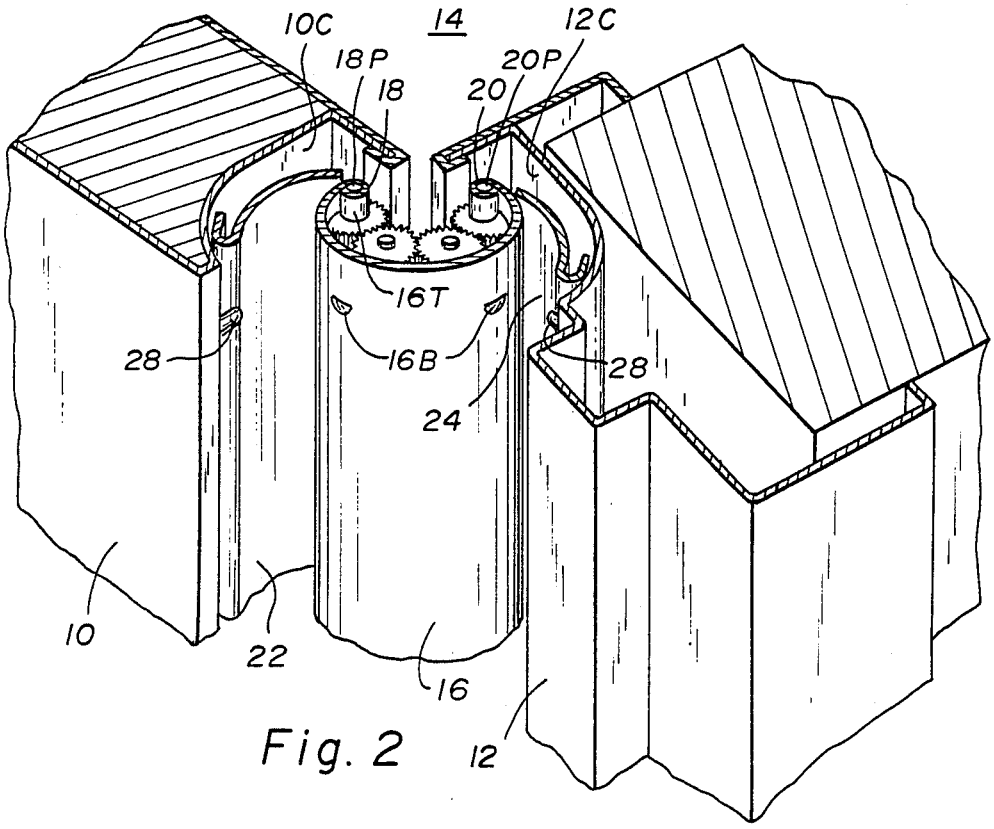
FIG. 2 is a perspective view, partly in section and partly broken away, of the door of FIG. 1, showing the door partly opened and showing the hinge assembly in detail.
Figure 3:
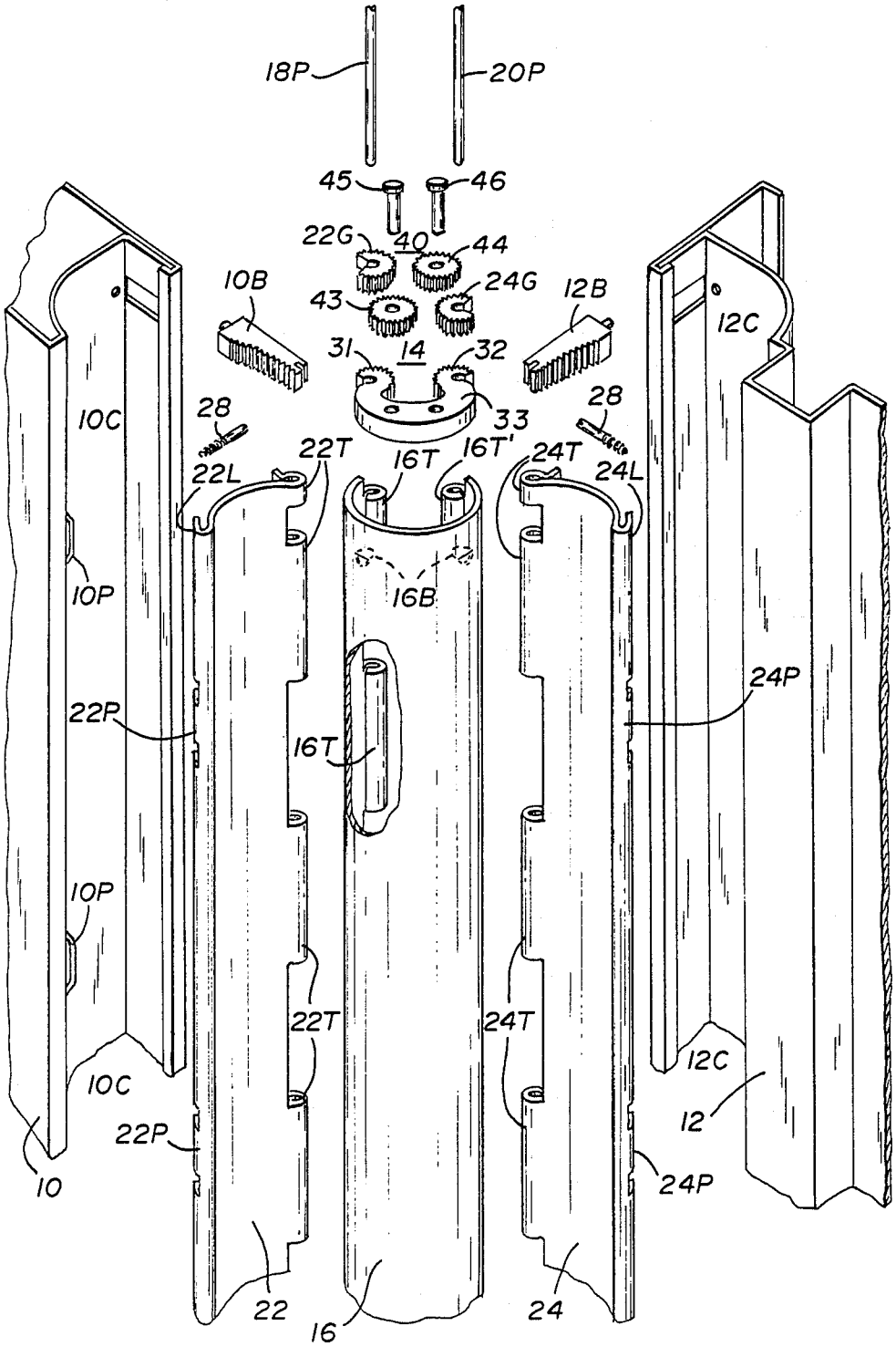
FIG. 3 is an exploded partial view with parts broken away to show interior parts of the hinge assembly and adjacent portions of the jam and door of FIGS. 1 and 2.
Figure 4:
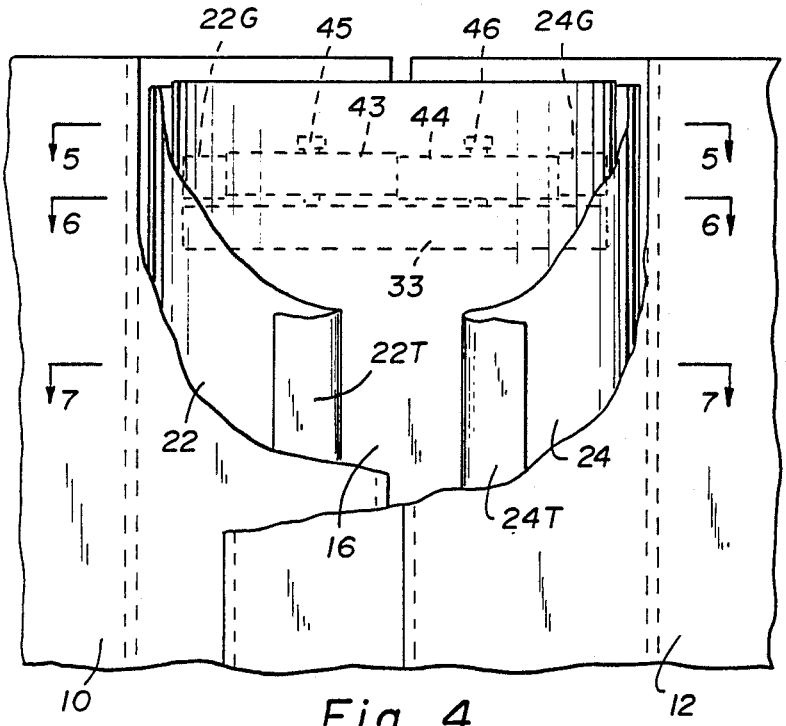
FIG. 4 is an elevational detailed view of the hinge assembly and adjacent door and jam of FIGS. 1–3, with parts broken away to show some interior parts and with other interior parts shown in phantom outline.

The hinge assembly 14, as is better seen in FIG. 2, includes a channel-shaped link member 16. The link member 16 extends along the height of the door 10 and helps form two continuous (piano-type) vertical hinges, a door-side hinge 18, and a jam-side hinge 20. These hinges 18, 20 are maintained at spaced-apart but parallel configuration by the link member 16. The channel 16 serves both hinges 18, 20 as one of their leaves. The hinge 18 is formed with a pivot pin 18P encircled by a number of tubular portions 16T for receiving the pin 18P. The other leaf of hinge 18 is formed by an arm member 22 which forms pin-receiving tubular portions 22T (which are best shown in FIG. 3). The hinge 20 is formed similarly, with the tubular portion 16T' of link member 16 receiving a pin 20P which is also received in tubular segments 24T of a jam arm member 24.

The members 16, 22 and 24 are preferably formed of sheet steel, with tubular sections 16T, 16T', 22T, and 24T formed by bending or curving over the sheet metal back upon itself. The arm members 22, 24 are preferably, as shown, mirror images of each other and, by judicious selection of the length and number of the tubular sections 22T, may be identically shaped parts with one turned upside down. When the door 10 is swung open, the curved surface of the link member 16 presents a pleasing appearance to the door hinge, as indicated in FIG. 2.

The arm members 22, 24 also have turned-over longitudinal marginal lips 22L, 24L, from which are formed horizontally-projecting tabs 22P at vertically-spaced intervals. The arm members 22, 24 are respectively secured within longitudinal extending grooves or cavities, 10C and 12C, respectively, in the door 10 and jam 12. A number of pockets, 10P and 12P, respectively, are formed in the cavities 10C and 12C (FIGS. 5, 7 & 8) to secure the tabs 22P, 24P, respectively. The jam 12 and door 10 are made of sheet steel as shown, and the pockets 10P and 12P may be easily constructed by forming short horizontal slits and pressing out the metal between the slits. This operation may be easily performed in a punch press with suitable tools and dies as part of the process of forming the sheet metal into the door and jam.

Figure 7:
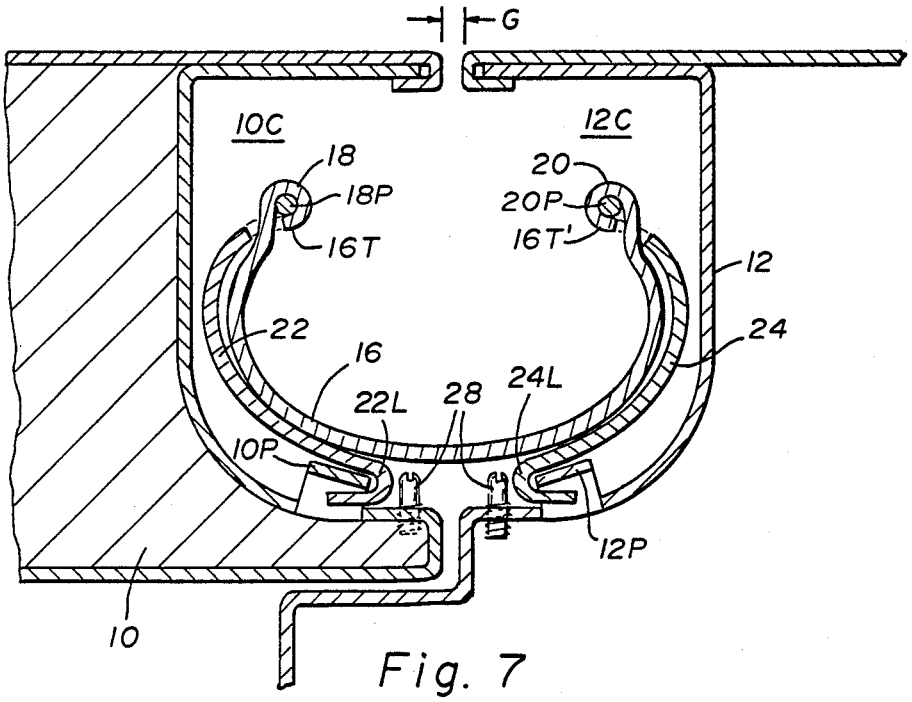
FIG. 7 is a sectional view of the assembly of FIGS. 1–6, as seen from the plane defined by the line 7—7 in FIG. 4 when looking in the direction of the arrows.
Figure 8:
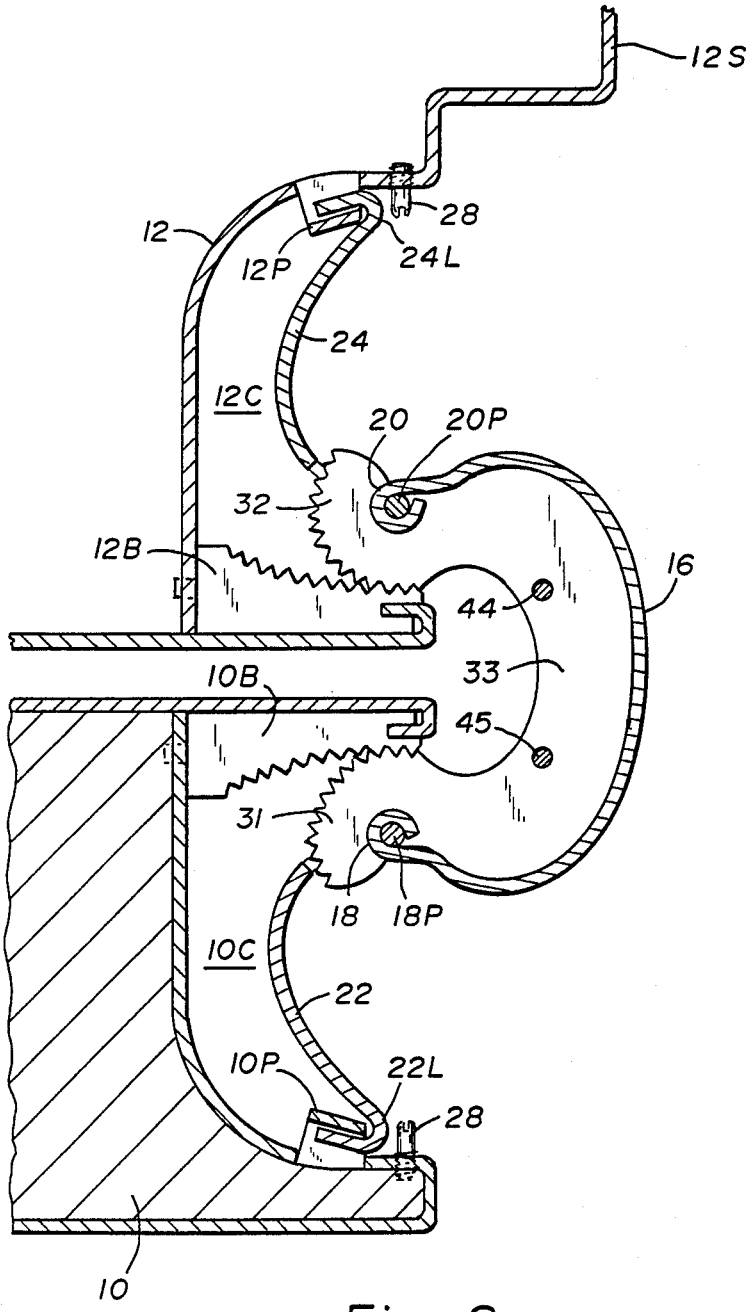
FIG. 8 is a view similar to that of FIG. 6 but with the door opened 180 degrees.

As best seen in FIGS. 7 and 8, the tabs 22P, 24P are secured in their pockets 10P, 12P in such a manner as to allow the arms 22, 24 to pivot slightly thereabout.

The weight of the door 10 is transferred via the pockets 10P to the tabs 22P and thus to the arm 22 through the hinge 18 to the link member 16. This weight is in turn carried by hinge 20 and arm member 24 and delivered to the jam through the tabs 24P and pockets 12P. As will be explained below, other ways of transferring the weight of the door may also be employed.

Figure 5:
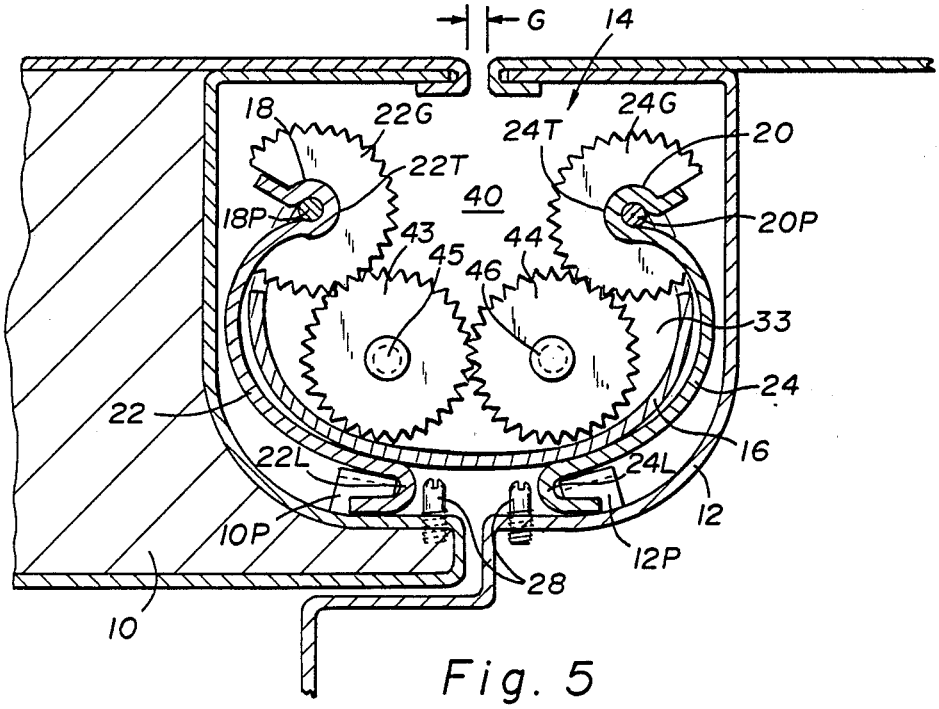
FIG. 5 is a sectional view of the assembly of FIGS. 1–4, as seen from the plane defined by the line 5—5 in FIG. 4 when looking in the direction of the arrows.
Figure 6:
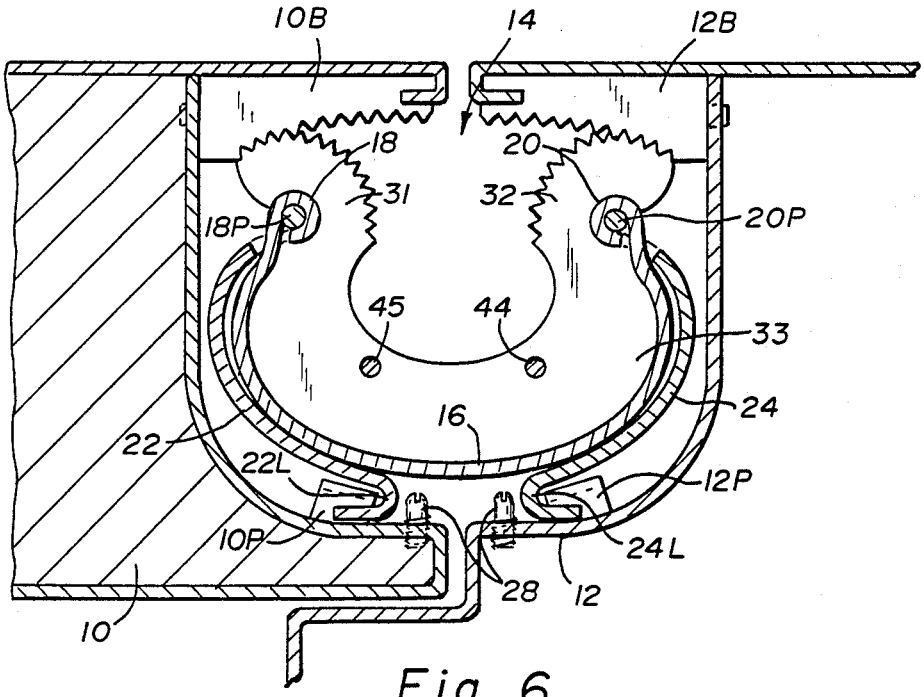
FIG. 6 is a sectional view of the assembly of FIGS. 1–5, as seen from the plane defined by the line 6—6 in FIG. 4 when looking in the direction of the arrows.

The arm members 22 and 24, after being installed in the cavities 10C and 12C by having the tabs 22P, 24P inserted into the pockets 10P, 12P, are thereafter held in place by installing set screws 28 that are received in the jam or door 10 (FIGS. 5–7). For conventional-height doors, a pair of such screws positioned near the top and near the bottom of the arm members 22, 24 would be sufficient (although for large doors more such set screws 28 may be provided).

Also in accordance with the present invention, means, generally designated 30, are provided for advancing at least one of the hinges 18, 20 from their closed inner positions, shown in FIGS. 5–7, wherein they are deep within the cavities 10C, 12C outward toward the positions shown in FIG. 8 wherein the hinges 18, 20 are nearly out of the cavities. This means 30 is a pair of partial gears 31, 32 fixed to the link member 16. The partial gear 31 has a central axis coincidental with the pivot 18, and the partial gear 32 has a central axis coincidental with the pivot 20.

The partial gears 31, 32 are preferably, as shown, formed from a single piece or shift plate 33, best shown in FIG. 3. The plate 33 conforms to and snaps into place within the link member 16 and rests on a pair of tabs 16B preferably made by being punched out of the body of link member 16 and bent inward.

The partial gears 31, 32, when installed as shown in FIGS. 6 and 8, respectively, mesh with gear blocks 10B, 12B, which are respectively secured to the door 10 and jam 12. The gear blocks 10B, 12B may be and preferably are identically sized and shaped parts. The gear sections of the blocks 10B and 12B have teeth that match those of partial gears 31 and 32 so as to allow the two to mesh together. The gear sections of blocks 10B and 12B are formed as part of a larger-diameter internal gear such that the partial gears 31 and 32 turn like planetary gears on the gear sections of blocks 10B and 12B. For example, for a $1\frac{1}{2}$ inch thick door, the partial gears 31, 32 may have a medium radius of approximately 0.215 inch while the concave gears section of blocks 10B, 12B might have a radius of curvature of 1.125 inch centered at about the lip 22L.

As the door 10 starts to swing open from the position shown in FIG. 6, one or both of the pivotal gears must move. Each of arms 22, 24 accommodate this movement on the blocks 10B, 12B and are each able to pivot about their attachment at 22L.

The gears 31, 32 and blocks 10B, 12B are of such a length as to allow the door to swing a full 180 degrees opening as shown in FIG. 8. It should be noted that the link member 16 projects out from the plane of the jam 12 at its maximum about the same distance as the door stop 12S. Also that a smooth curved outside appearance will be provided over the length of the door and jam by the link member 16 and arms 12, 24.

As the door swings shut, the partial gears 31, 32 operate on the gear blocks 10B, 12B to retract the hinges 18, 20 back into the cavities 10C, 12C of the door 10 and jam 12.

The advancing of the hinge pivots out from the door and jam as the door opens allows there to be a smaller gap or separation (G) (FIG. 5) between the door and the jam that would otherwise exist with a two-pivot concealed hinge such as that described in the aforementioned Yulkowski patent.

It is desirable that the door open and close symmetrically; that is, that the pivotal movement of arms 22 and 24 be equal and that the partial gears 31 and 33 advance equal distances along the blocks 10B and 12B. To this end, coordinator means 40 is provided, best shown in FIG. 5.

The coordinator 40 includes two partial gears 20G, 24G secured, respectively, to the arm members 20, 24 and centered at the hinges 18, 20. Coordinator 40 also includes two full gears 43, 44 mounted for rotation on the plate 33. These gears 43, 44 rotate on axles 45, 46, respectively, which are mounted into the plate 33.

As the door starts to swing open and one or the other units is advanced by the partial gears 31, 32 acting on gear block 10B or 12B as described above, this movement also rotates gear 20G or 24 and is transferred through the coupled gears 43, 44 to the other arm gear 24G or 20G, thus insuring that both gears 20G and 24G rotate equal amounts and that therefore the door open and close approximately symmetrically. (While, in theory, the coordinator 40 should insure absolute symmetrical opening and closing, the normal "give" of materials and allowances for tolerances between parts will result in some asymmetricality. It is not necessary, of course, to be precisely symmetrical, only approximately so to achieve the desired results.)

While we have shown and described one set of advancing and retracting means 30 and coordinator means 40 at the top of the door 10 and jam 12, and one is considered adequate for conventional interior doors—more than one may be used. Thus, for heavier exterior doors or larger doors, a second unit 30–40 could be installed at the bottom of the door and provision for even more such units provided at intermediate positions for extremely large and heavy doors.

Second Embodiment

Figure 9:
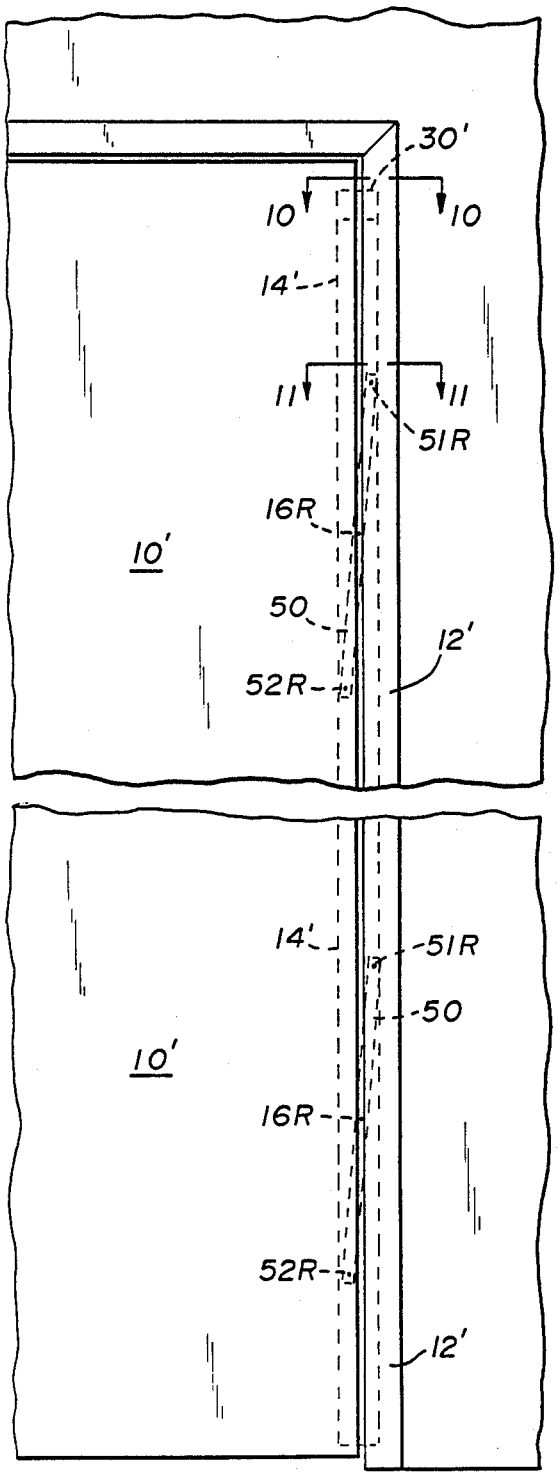
FIG. 9 is a broken elevational view of a second door, jam, and hinge assembly, constituting a second embodiment of the present invention, with interior parts shown in phantom outline.
Figure 10:
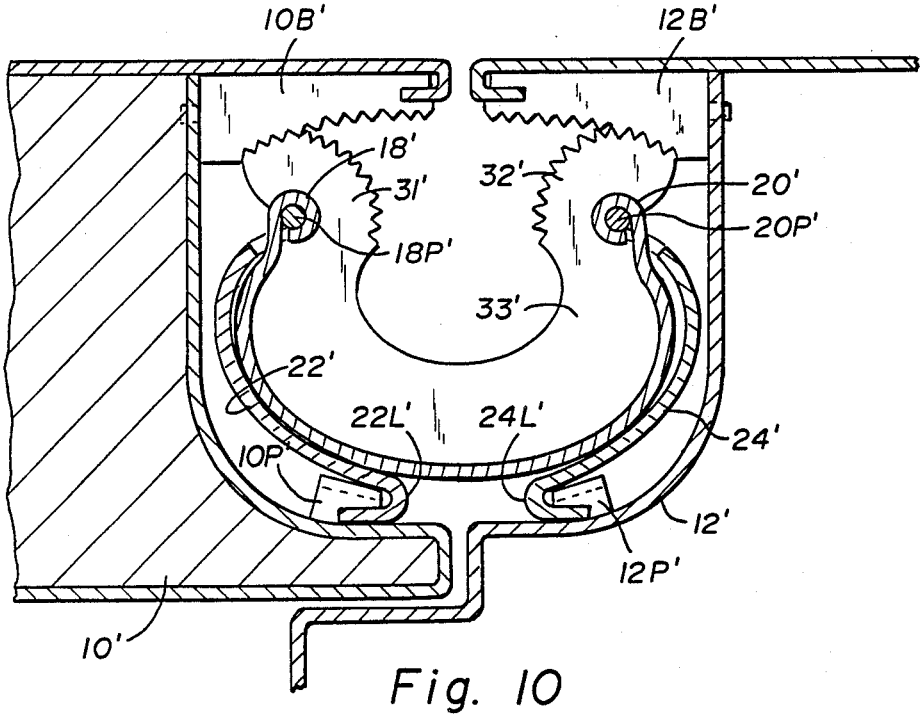
FIG. 10 is a sectional view of the apparatus of FIG. 9, as seen from the plane defined by the line 10—10 in FIG. 9 when looking in the direction of the arrows.

Referring to FIGS. 9 through 12, a second embodiment of the invention is there disclosed. In this case, the pivot or hinge retracting and advancement meshing is as shown in FIG. 10 essentially the same as that of the first embodiment described above, but the gear plate 33′ does not bear coordinator gears.

Figure 11:
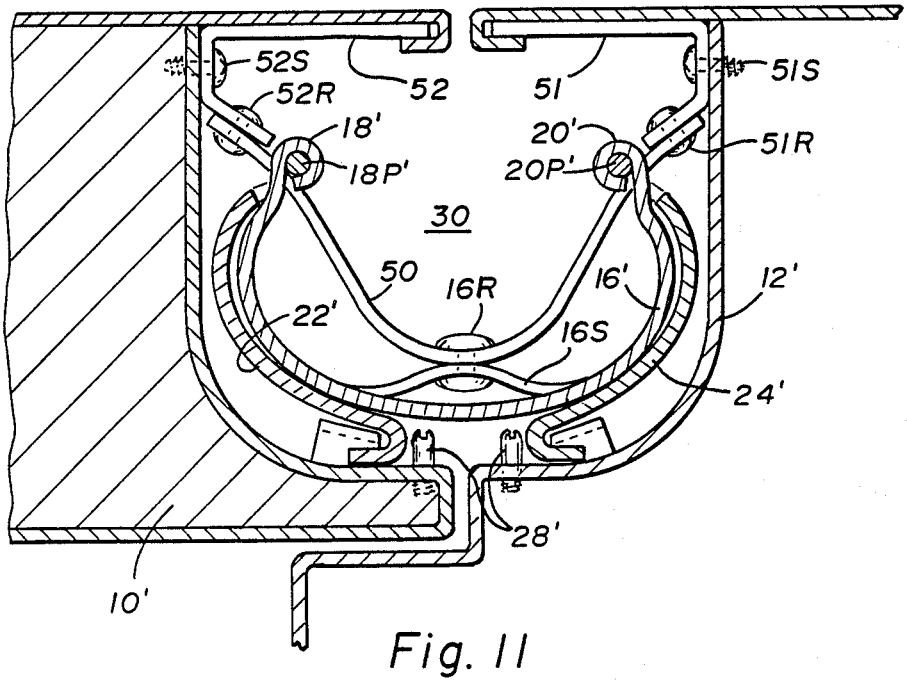
FIG. 11 is a sectional view of the apparatus of FIGS. 9 and 10, as seen from the plane defined by the line 11—11 in FIG. 9 when looking in the direction of the arrows.
Figure 12:
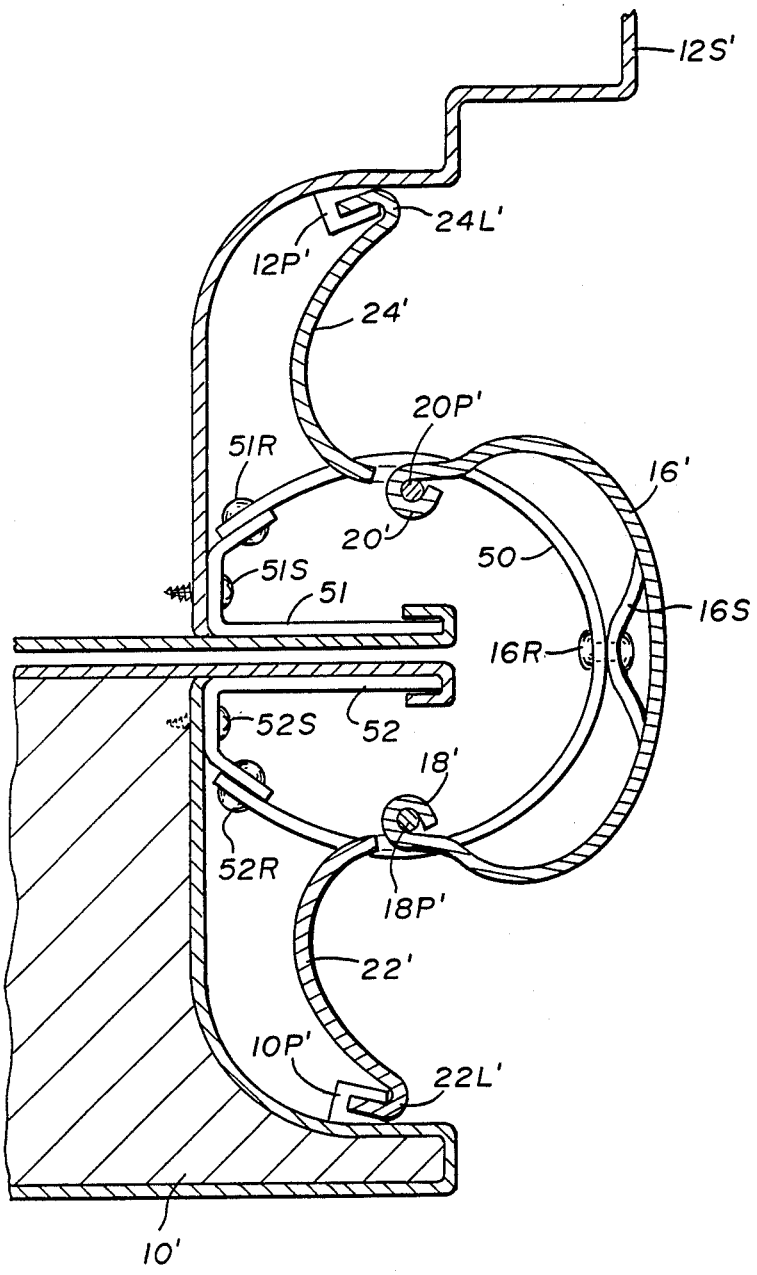
FIG. 12 is a view similar to that of FIG. 11 but with the door opened 180 degrees.

In this embodiment, both coordinator and load bearing and transfer are achieved by means of a pair of flexible hangar straps 50 shown in FIGS. 9, 11, and 12. The strap 50 is pivotally affixed by means of a rivet 51R to a bracket 51 affixed within the cavity 12C to the jam 12. The hangar strap 50 extends diagonally through slit openings formed in the jam arm 14′ and through a similar slit opening formed in the link member 16′. This link member 16′, as shown in FIG. 11, has an insert portion 16S at its center, and the strap 50 is pivotally secured by means of a rivet 16R to this insert 16S. The other end of the strap 50 passes through slots formed in the other side of the link 16′ and through the arm 22′ and is also pivotally secured by means of a rivet 52R to a bracket 52 that is secured to the door 10′ by means of screws 52S or other suitable means.

In this embodiment, the hinges 18′, 20′, arms 22′, 24′, and pockets 10P′, 12P′ need not bear as much weight as before and indeed only shorter versions of these may be employed. The hinges 18′, 20′ are, however, constructed so that the door may rise slightly as it achieves its open position.

The flat strap 50, even though flexible in the views shown (FIGS. 11 and 12), is not elastic but is preferably made of steel or other suitable metal and oriented vertically does not flex in the vertical plane. The strap being affixed at 51R to the jam 12 and at 16R to the link 16′ and at 52R to the door 10, thus by keeping the length along its vertical surface between rivets 52R and 16R equal to that of between 16R and 51R, serves to maintain the link 16′ symmetrically positioned between the door and jam as the door opens and closes and thus serves as a second coordinator means 30′ which insures that the hinges 18′, 20′, each advance and retreat approximately the same distance.

Besides the function of coordination and weight transfer, the strap 50 also serves as a self-closing mechanism. This is so because the horizontal distance between the rivets 51R and 52R along the path taken by the strap 50 increases slightly as the door is opened. Since the strap 50 does not stretch, this means the door must rise slightly and the stored energy using the weight of the door is available and restored as the door moves back toward closure. The amount of rise of the door and thus the force urging it to close is proportional to the length of the strap 50. Thus, by adjusting this length and matching it to the weight of the door and the frictional resistance of the hinge assembly, the door may be made self-closing or not. A large strap 50, e.g., one extending the entire length of the door 10, would raise the opening door less than the shorter straps depicted in FIG. 9 and thus would have less of a tendency to urge the door toward closing.

This second embodiment has the advantage of hidden hinges and narrow gaps present in the prior embodiment and provides design flexibility in thinner or less extensive sheet metal which may be used in forming the arms 22′, 24′, and link 16′ since the major part of the weight of the door is borne by the strap 50. For example, the hinges 18′, 20′ might be formed at only the bottom and top of the door 10′.

Third Embodiment

The prior two embodiments were specifically for steel or metal (or metal-skinned) doors which are gaining in popularity in this country. Wood doors are, however, still quite common and often preferred for their qualities. Such doors, whether solid, hollow, or foam-filled, present unique problems in hanging. However, the present invention may also be employed with such wood doors.

Referring now to FIGS. 13–16, there is depicted a wood door 10″ and jam 12″ which employ a hinge assembly 14″ constructed in accordance with the present invention. In this embodiment, the assembly 14″ includes a pair of inlet metal channels 10C′, 12C′ that extends the height of the door 10″ and jam 12″ and defines the recessed channels or grooves in this embodiment. These channels 10C′, 12C′ may be secured by any convenient means such as the wood screws shown in FIG. 15.

The assembly 14″ includes a link member 16″ that preferably also extends for the height of the door 10″. The weight of the door 10″ is transferred to the link member 16″ in this embodiment by a pair of hangars 70, one of which is positioned in the upper portion of the door 10″, and the other of which is positioned in the lower portion, as shown in FIG. 13. The hangars 70 are preferably made of flat steel stock but are not especially flexible nor malleable but are instead formed permanently into the general S-shape shown. The wall of the channel 12C′ is preferably slit and formed outward to provide downward opening pockets such as the pocket 72, shown in FIG. 16, to receive the bent-up hook bottom end 70B of the hangar 70. The link 16″ is slit to form a surface to receive the top hook 70T (FIGS. 16 and 17).

The upper end of the hangar 80 is also formed into a hook 80H and holes and/or upward opening pockets 76 are formed in link member 16″ to receive the hook so provided.

Thus, the weight of the door 10'' may be carried by the hangars 70 and transferred 72 to the link member 16''.

A second set of hangars 80, which may be identical to the hangars 70, are similarly affixed between the link member 16'' and the jam channel 12C'. As shown in FIG. 16, the hangars 70, 80 and link member 16'' are arranged to be symmetrical about the plane of the gap between the door 10'' and jam 12''.

The assembly 14'' also includes arm members 20'', 14'' which may be similar to those described in the prior embodiments except that they are slit so as to closely accommodate the hangars 70 and 80 (FIGS. 14*a* and 14*b*). It is important that the arms' surfaces bear against or closely receive the hangars 70 and 80 such as in the manner shown in FIG. 14*a* for reasons that will be explained below. The hinges 18'', 20'' should also be constructed so as to allow the door 10'' to rise slightly as it opens.

Referring to FIG. 15, a modified coordinator 40' is there depicted. This coordinator 40' includes a gear plate 33' that is secured to the link member 16'' and mounts four gear axles 81, 82, 83 and 84 on which are riveted four intermeshing gears 85, 86, 87 and 88. These gears mesh with partial gears 22G' and 24G', affixed in a manner similar to that of gears 22G and 24G of the first embodiment.

Four gears are substituted for the two gears of the first embodiment so as to allow a narrower horizontal width for the inserted channels 10C', 12C', so that they can more easily fit into wood doors and jams with sufficient wood left over to provide strength and so as to prevent splitting of the wood.

Referring to FIGS. 14*a* and 14*b*, it should be appreciated that as the hangar 80 pivots outward, it contacts the arm 24'' at the edge 240 and moves the arm 24'' outward (in the direction of the arrows) to advance the hinge 20 outward from the jam. As it swings inward, the hangar 80 contacts the edge 221 of the arm 24'' and thus retracts the hinge 20'' back into the door as it closes.

A similar arrangement is provided between hangar 70 and arm 22'' for advancing and retracting the hinge 18''.

Thus, it can be seen that the hinges 18'' and 20'' are both advanced out of their respective doors and jams upon swinging open the door and retracted back as the door closes. Because of the coordinator mechanism (FIG. 15), this advancing and retracting is kept approximately equal and symmetrical.

Fourth Embodiment

Referring to FIG. 18, a fourth door 10''' is depicted, together with a jam 12''' and a fourth hinge assembly 14''', also constructed in accordance with the present invention. This is another wood door hinge assembly arrangement. This assembly 14''' includes two long flexible hangar straps 50' which are each affixed by a rivet 51R' to the jam and by rivet 52R' to the door 10''', as best seen in FIGS. 19 and 20. The straps 50' are riveted through projections 10Z, 12Z from the insert walls 10C'', 12C''. The straps 50' are, by nature of their flat shape, laterally flexible when bent, as shown in FIG. 20, but not vertically flexible or flexible in the plane in which they lie.

The apparatus 14''' includes a pair of arms 22''', 24''' and link 16''' which may be constructed as in the other embodiments, except for appropriate slits to accommodate the hangar strap 50' which passes through each of these members. The center of the strap 50' is pivotally affixed by means of a rivet 16R' in the manner of the second embodiment of FIGS. 9–12.

Also in the same manner as in that embodiment, the strap 50' serves to both transfer weight and by the triangular relationship (made perhaps clearest in FIG. 21), to coordinate the movement of the hinges 18''' and 20''', so as to maintain them symmetrically positioned as the door opens and closes. The strap 50' being relatively inflexible in the plane of its flat side insures that the rivet 16'' is centrally located.

In this embodiment, as also best shown by FIG. 21, the longer strap 50' also serves with the arm members 22''' and 24''' and the surfaces 221''221', 240', 240'' of the arms 22''', 24''' as the means for advancing and retracting the pivots 18''', 20''' in the same manner as in the third embodiment (FIGS. 14*a* and 14*b*).

This fourth embodiment has the advantage of having fewer moving parts and being therefore easier to manufacture and install. With a long length for the strap 50', the door need only rise a small distance upon opening. For example, if the strap 50' is about 48 inches long and the inlet about 1½ inches each for 10C and 12C, the rise would be less than eight one-hundredths of an inch.

For purposes of explanation and particularly of disclosure of the preferred embodiments, but not for purposes of limitation of the scope of the invention, we will now set out some presently preferred sizes and materials for the particular examples described and depicted above. Such values as are here set out are believed to be accurate and complete; however, the reader is cautioned against any possible inadvertent error in compilation or printing and advised to verify these values mathematically and/or experimentally before using them. Although these are the currently preferred values and materials, the present inventor may well decide in the future to vary from these because of experience or for reasons of economy.

With these factors in mind, the gears 22G, 24G, 43, 44, and block 10B, 12B, and member 33 are preferably about ½ inch high, with a medium gear diameter of ½ inch and made out of nylon, steel, or aluminum. The walls forming the cavities 10C, 12C are preferably 16 gauge steel or aluminum sheet metal, and the members 16, 22, and 24 in all embodiments are preferably made of 14 gauge steel. The straps 50 are preferably 1/16-inch-thick by ¼ inch-wide flat steel straps, with the larger straps 50' being 1/16 inch by ½ inch and three to four feet in length.

It should now be appreciated that a novel hinge assembly has been provided which is versatile and can be adapted to many different types of doors and provides advantages over prior such assemblies.

While four particular embodiments of the invention have been shown and described, it will be obvious to those skilled in the art that changes and modifications may be made without departing from the invention and, therefore, the aim in the appended claims is to cover all such changes and modifications as fall within the true spirit and scope of the invention.

I claim:

1. A door-hinge assembly for a swinging door having a jam, comprising:

a first hinge positioned adjacent to or within the door;

a second hinge positioned adjacent to or within the jam;

said first and second hinges having axes of rotation generally parallel to one another and being coupled together at a fixed spacing and being coupled, respectively, to the door and the jam; said latter coupling being such as to allow movement of the first and second hinges relative to the door and jam respectively;

means for advancing and retracting the position of the axis of said first hinge a distance relative to the door;

means for advancing and retracting the position of the axis of said second hinge a distance relative to the jam; and, coordinator means for coordinating the advancing and retracting of the first and second hinges, so that they both advance at approximately the same time and retract at approximately the same time, as the door swings open and shut.

2. The door-hinge assembly as defined in claim 1, wherein:

said coordinator means and means for advancing and retracting also serves to advance and retract the first and second hinges by approximately the same distances as the door swinges open and shut.

3. The hinge assembly as defined by claim 2, wherein:

said hinges are connected by a link member which is generally U-shaped in cross section and helps form said first and second hinges, with said hinges being defined at the ends of the U-shaped member.

4. The hinge assembly as defined in claim 3, wherein:

said first hinge is connected to the door by means of a first arm member, and said second hinge is connected to the jam by means of a second arm member.

5. The invention of claim 4, wherein:

said U-shaped link member and said first arm member form the said first hinge, and said link member and said second arm member form the said second hinge.

6. The invention of claim 5, wherein:

said hinges are of the piano type and extend substantially for the length of the door.

7. A swinging door hinge assembly for use with a swinging door and door jam, comprising:

means for being affixed to a door jam and defining a pivotally displaceable first arm, affixable at one end to the jam and having its other end pivotally displaceable from a home position to an extended position, the latter position being extended closer to the closed position of the door than the home position;

means for being affixable to the door and defining a second pivotally displaceable arm, affixable at one end to the door and having its other end pivotally displaceable from a home position to an extended position, the latter position being extended closer to the closed position of the jam than the home position;

link means coupled to both of said arms and moving with them as they move from its home to its extended position;

cam and cam follower means coupled to said link means and said arms, affixable to the jam and the door for pivotally advancing to the extended position said arms, as the door swings open, and for retracting said arms to their home positions as the door swings shut; and gear means coupled between said arms for coordinating the pivotable displacement of said first and second arms so that they move in accordance with a predetermined fixed relationship; and wherein:

said link means forms with each of said arms a pivoting hinge, said cam and cam follower means includes at least two gear units, one of which is concentric with each of the pivoting hinges formed by said link means and said arms, and also includes at least two gear segments, one of which is affixable to the jam, and the other to the door, so as to mesh separately with one of said gear units, with said gear units which are affixed to the link means, so that pivoting of the link means relative to the arm at said pivoting hinge causes the associated gear to move relative to the gear segment and thus causes the associated arm to be pivotably displaced.

8. The hinge assembly as defined in claim 7, wherein: said gear means includes at least two gear members, one of which is affixed to said first arm, and the other of which is affixed to said second arm, and at least two idler gears intercoupling said two gear members, whereby the pivotable displacement of said link means relative to said first arm is coordinated with and kept approximately the same as the pivotable displacement of said second arm.

9. A hinge assembly for use with a swinging door and its jam, comprising:

a link member;

a first member couplable to the jam and forming with said link member a movable first pivotal hinge, said first pivotal hinge being movable from a home position to an extended position, which extended position is outward from the jam relative to its home position;

a second arm member couplable to the door and forming with said link member a movable second pivotable hinge, said second pivotable hinge being movable from a home position to an extended position, which extended position is outward from the door relative to its home position;

means for causing the movement of said first hinge between its home and extended position as that first hinge turns;

means for causing the movement of said second hinge between its home and extended positions as that second hinge turns.

10. In combination with a door and door jam for receiving the door, a hinge unit, comprising:

a link member having two spaced-apart vertical hinges, one of which hinge is coupled to said jam and the other of which hinge is coupled to said door, means for permitting said one hinge to move out from and toward said jam;

means for permitting said other hinge to move out from and toward said door;

means for coordinating the movement of said hinges out from or toward the door or jam, such that they each advance or retreat approximately the same distance; and means for causing the advancement of the hinges as the door opens and for causing the retreat as it closes.

11. In combination:

a door;

a jam for the door;

a hinge assembly coupled between the door and its jam, comprising:

means defining a vertical first hinge including means for allowing the first hinge to move horizontally over a range of positions from a home position within the jam toward a position outward from that home position;

means defining a second vertical hinge including means for allowing the second hinge to move horizontally over a range of positions from a home position within said door's edge toward a position outward from the door from that home position;

said first and second hinges being connected together but separated by a fixed horizontal distance;

means for advancing the first hinge from the home position toward the outward position as the first hinge turns in one direction and for retracting it toward its home position as the first hinge turns in the opposite direction;

means for advancing the second hinge from the home position toward the outward position as the second hinge turns in one direction and for retracting it toward its home position as the second hinge turns in the opposite direction; and means for coordinating the turning of the first hinge with that of the second hinge, so that they both turn at approximately a predetermined ratio.

12. The combination of claim 11, wherein:

said means for advancing and retracting the first hinge advances and retracts it in essentially the same ratio of distance to degree of turn as does the means for advancing and retracting the second hinge; and the ratio of turning between the first and second hinges defined by said coordinating means is one to one.

13. The combination of claim 11, wherein said door is a wood door.

14. The combination of claim 11, wherein said door is a metal door.

15. The combination of claim 11, wherein said means for allowing at least one of said hinges to move horizontally includes an arm member that is affixed to the jam at one horizontal end and is affixed to the hinge at its other end and may have its other end move outward.

16. The combination of claim 11, wherein said means for advancing and retracting at least one of said hinges is a gear section centered at that hinge which turns with the hinge and a meshing rack gear segment affixed to the adjacent door or jam, so that turning of the gear section causes it to move along the rack gear segment.

* * * * *